US011215413B2

(12) United States Patent
Satzinger et al.

(10) Patent No.: US 11,215,413 B2
(45) Date of Patent: Jan. 4, 2022

(54) RETROFIT ASSEMBLY FOR A SHORT WEAPON

(71) Applicant: Frank Satzinger, Nuremberg (DE)

(72) Inventors: Frank Satzinger, Nuremberg (DE); Frank Kaltenpoth, Ried (DE)

(73) Assignee: Frank Satzinger, Nuremberg (DE)

( * ) Notice: Subject to any disclaimer, the term of this patent is extended or adjusted under 35 U.S.C. 154(b) by 0 days.

(21) Appl. No.: 16/714,035

(22) Filed: Dec. 13, 2019

(65) Prior Publication Data

US 2020/0191508 A1 Jun. 18, 2020

(30) Foreign Application Priority Data

Dec. 18, 2018 (DE) ..... 102018132756

(51) Int. Cl.

| | |
|---|---|
| ***F41A 11/02*** | (2006.01) |
| ***F41C 23/12*** | (2006.01) |
| ***F41A 3/66*** | (2006.01) |
| ***F41C 7/00*** | (2006.01) |
| ***F41C 3/00*** | (2006.01) |
| ***F41A 11/04*** | (2006.01) |

(52) U.S. Cl.

CPC ..... *F41A 3/66* (2013.01); *F41A 11/02* (2013.01); *F41A 11/04* (2013.01); *F41C 3/00* (2013.01); *F41C 7/00* (2013.01)

(58) Field of Classification Search

CPC ..... F41A 11/00; F41A 11/02; F41A 11/04; F41A 35/00; F41C 23/12

See application file for complete search history.

(56) References Cited

U.S. PATENT DOCUMENTS

| | | | | |
|---|---|---|---|---|
| 1,367,996 A * | 2/1921 | Sussman | F41A 9/53 42/72 |
| 2,056,975 A | 3/1934 | Michal, Jr. et al. | |
| 3,685,194 A * | 8/1972 | Coon | F41C 23/12 42/77 |
| 5,448,940 A * | 9/1995 | Schuetz | F41A 3/26 89/128 |
| 6,318,014 B1 * | 11/2001 | Porter | F41C 23/12 42/71.01 |

(Continued)

FOREIGN PATENT DOCUMENTS

| | | |
|---|---|---|
| WO | 2013132291 A1 | 9/2013 |
| WO | 2014201478 A1 | 12/2014 |

OTHER PUBLICATIONS

Jeremy S.: Gear/Gun Review: Mechtech C.C.U. (Carbine Conversion Unit), Dec. 26, 2014, https://www.thetruthaboutguns.com/mechtech-c-c-u/, access May 17, 2021.

(Continued)

*Primary Examiner* — Derrick R Morgan

(74) *Attorney, Agent, or Firm* — Laurence A. Greenberg; Werner H. Stemer; Ralph E. Locher

(57) ABSTRACT

A conversion kit for a handgun is particularly suitable for converting a pistol into a pistol carbine. There is described the implementation of such a conversion kit, a conversion method and also a handgun that is converted in this way. The conversion kit for the handgun includes a housing. The housing is configured for establishing a connection to a frame of the handgun and for this purpose it has a linear guide for receiving the handgun frame.

8 Claims, 2 Drawing Sheets

(56) References Cited

U.S. PATENT DOCUMENTS 6,401,379 B1 * 6/2002 Moon ..... F41A 3/66 42/71.01
D696,374 S * 12/2013 Faifer ..... D22/108
8,819,975 B2 * 9/2014 Herring ..... F41A 3/66 42/6
8,887,432 B2 * 11/2014 Oz ..... F41C 23/12 42/71.02
9,696,101 B2 * 7/2017 Kada ..... F41A 11/02
10,161,709 B1 * 12/2018 Wright ..... F41A 19/183
D853,516 S * 7/2019 Ozaysin ..... D22/103
10,345,074 B1 * 7/2019 Zamlinskiy ..... F41C 23/16
2005/0263147 A1 * 12/2005 Hatcher ..... F41A 19/10 124/31
2009/0282718 A1 * 11/2009 Bartley ..... F41C 23/12 42/75.03
2010/0024274 A1 * 2/2010 Lippard ..... F41A 21/36 42/70.05
2010/0031812 A1 * 2/2010 Kerbrat ..... F41A 3/38 89/190
2010/0186276 A1 * 7/2010 Herring ..... F41C 23/04 42/6
2011/0030258 A1 * 2/2011 Fistikchi ..... F41C 23/22 42/1.06
2011/0088305 A1 * 4/2011 Oz ..... F41A 35/06 42/69.01
2012/0131829 A1 * 5/2012 Fistikchi ..... F41C 23/04 42/1.06
2013/0036644 A1 * 2/2013 Bardy ..... F41A 19/14 42/69.03
2013/0247440 A1 * 9/2013 Maentymaa ..... F41G 1/00 42/111
2014/0165442 A1 * 6/2014 Nebeker ..... F41A 3/64 42/16
2015/0241154 A1 * 8/2015 Istvanovics ..... F41A 19/09 89/140
2015/0316346 A1 * 11/2015 Brandt ..... F41C 23/12 42/71.02
2016/0116252 A1 4/2016 Kincel
2016/0146558 A1 * 5/2016 Kada ..... F41A 3/56 42/16
2017/0131051 A1 * 5/2017 Albury ..... F41C 23/00
2017/0321980 A1 * 11/2017 Wolf ..... F41A 21/488
2018/0023912 A1 * 1/2018 Cudazzo ..... F41A 9/70 89/136
2018/0195822 A1 7/2018 Jonsson
2019/0093983 A1 * 3/2019 Bruegger ..... F41A 3/66
2019/0107348 A1 * 4/2019 Harrigan ..... F41A 5/02
2019/0107363 A1 * 4/2019 Harrigan ..... F41A 11/00
2019/0154368 A1 * 5/2019 Kim ..... F41C 23/10
2019/0195595 A1 * 6/2019 Kielsmeier ..... F41C 33/08
2019/0226798 A1 * 7/2019 Faifer ..... F41C 23/12
2019/0242668 A1 * 8/2019 Barrett ..... F41A 21/30
2019/0323795 A1 * 10/2019 Zimmer ..... F41C 23/04
2020/0103191 A1 * 4/2020 Macy ..... F41A 19/15

OTHER PUBLICATIONS

American Rifleman Staff: "Tested: MechTech Carbine Conversion Unit", NRA American Rifleman, Feb. 1, 2017, https://www.americanrifleman.org/articles/2017/2/1/tested-mech-tech-carbine-conversion-unit/, access May 18, 2021.
Mech-Tech Systems Inc.: "Mech-Tech System '1911' Model CCU", Operation & Maintenance Manual 2010 access May 18, 2021.
Youtube: MechTech CCU (Glock Carbine Conversion Unit), Dec. 23, 2014 https://www.youtube.com/watch?v=IL24ni91RAE.
Youtube: "Quick Review MechTech CCU Carbine Conversion Unit", Jan. 1, 2018 https://www.youtube.com/watch?v=_R4PP1q2aUM&list=PLDnvkoKelyIUkd8RtoN6akoZJQbA8bA1&index=4.
Youtube: "Mech-Tech CCU For The Glock—How it works", Apr. 3, 2013 https://www.youtube.com/watch?v=tYMCQyUVkMg.

* cited by examiner

RETROFIT ASSEMBLY FOR A SHORT WEAPON

BACKGROUND OF THE INVENTION

Field of the Invention

The invention relates to a conversion kit for a handgun, in particular for converting a pistol into a pistol carbine. In addition, the invention relates to the use of such a conversion kit, to a conversion method and also to a handgun converted in this way.

In order to increase the operating range and hit probability of a handgun, the simplest known solution is that of retrofitting attachable buttstocks.

In recent years, conversion kits for converting pistols into pistol carbines have also been presented. Examples of such conversion kits are the "Triarii" system from the Hera Arms company, the "RONI" system from the CAA Tactical company and the "K-Pos" system from the FAB Defense company. Along with a housing, these accessory systems generally also include a forward grip, mounting rails for sights and tactical flashlights and also holders for additional magazines, etc. It is also of advantage that, after the conversion, the comparatively inexpensive handgun ammunition can continue to be used. Since a handgun converted in this way is also still legally classified as a handgun, existing handgun magazines can continue to be used.

Typically, in the case of the known conversion kits, the handgun is fastened as it is in the housing. Along with the shoulder stock, on this housing there are then also the aforementioned further functional elements. Generally, the fastening of the handgun in the housing of the conversion kit is performed on the basis of the swing-in principle. The handgun is placed with its front end into the housing, in order subsequently to be swung into its final mounting position in the housing by a pivoting movement. In this final position, the handgun is subsequently fixed by means of bolts or other suitable connecting elements. Another possibility for fastening is that the existing pistol is placed into a housing consisting of two half-shells and the two half-shells are subsequently screwed or connected to one another in some other way.

In the case of the solutions that are known from the prior art, the manner of fastening the handgun in or on the housing is often unsuitable or inadequate. For instance, depending on the type of construction, there may be increased wear of components that rub against one another, which in the case of heavy use can lead to increased backlash. A lacking accuracy in repetition of the fastening of the handgun in the housing can also lead to problems of precision, which are manifested in an increased dispersion in the pattern of hits.

Likewise long known from the prior art are so-called interchangeable systems. An interchangeable system in the narrowest sense, in particular in the case of self-loading pistols, is understood as meaning the possibility of changing the caliber and/or the length of the barrel. Such an interchangeable system primarily consists of a barrel, possibly with a breechblock group and further components, which are exchanged for the original parts of the basic weapon.

Brief Summary of the Invention

An object of the present invention is to make it particularly easy to convert a handgun, in particular a pistol into a pistol carbine.

This object is achieved by a conversion kit as claimed and by the subjects of the alternative independent claims. Advantageous configurations of the invention are specified in the dependent claims.

The advantages and refinements explained below in connection with the conversion kit also apply analogously to the method according to the invention and to the subjects of the other alternative independent claims, and vice versa.

A conversion kit according to the invention for a handgun comprises a housing, wherein the housing is designed for establishing a connection to a frame of the handgun and for this comprises a linear guide for receiving the handgun frame.

A method according to the invention for converting a handgun is characterized in that the handgun frame is pushed into a linear guide of the housing.

The invention also concerns the use of such a conversion kit for converting a handgun and also the use of a linear guide for connecting a handgun frame to a housing of a conversion kit for a handgun.

The invention combines features of an interchangeable system, such as the use of a longer barrel, with features of a conversion kit, such as the use of a housing with an optional shoulder stock, and supplements this combination with a novel way of fastening the handgun, to be more precise the handgun frame, to the housing of the conversion kit. Therefore, the housing of the conversion kit is also referred to hereinafter as the interchangeable system housing.

An idea of the invention is to provide a linear guide on the housing of the interchangeable system for receiving the handgun frame in the case of handgun interchangeable systems. A linear guide is understood in this case as meaning a straight guide with the aid of which the handgun frame can be moved on a straight line toward the interchangeable system housing, wherein the two parts are joined together in a linearly movable manner to form a direct, immediate contact. To put it another way, the linear guide allows guidance on an exactly straight line. The linear guide can therefore also be referred to alternatively as "linear guidance".

The invention in other words proposes attaching the handgun frame to the interchangeable system housing in the same manner as attaching the handgun frame to the handgun breechblock of the original handgun. To put it another way, the slide system known per se, that is to say the movement of the breechblock on the frame in the manner of a slide, is adapted according to the invention for establishing the connection of the handgun frame to the housing of the interchangeable system.

The use of a linear guide means that conversion of a handgun, in particular a pistol into a pistol carbine, can be carried out particularly easily. Very easy assembly and disassembly of the interchangeable system are possible, since it is only necessary to perform a linear insertion movement, with which the handgun frame is mounted in the linear guide of the interchangeable system housing. Further advantages that are obtained are also that the handgun frame can be fastened on the housing of the interchangeable system very securely, in particular in a stable and mechanically load-bearing manner. The fastening can be repeated particularly accurately, so that no problems of precision occur.

With the invention it is possible to convert a short-range handgun, such as for example a Glock pistol, in an easy way into a carbine system, which has an increased range of over 100 m and improved precision. The conversion can in this case be performed quickly and reversibly.

BRIEF DESCRIPTION OF THE SEVERAL VIEWS OF THE DRAWING

An exemplary embodiment of the invention is explained in more detail below on the basis of the drawings, in which.

DESCRIPTION OF THE INVENTION

Figure 1:
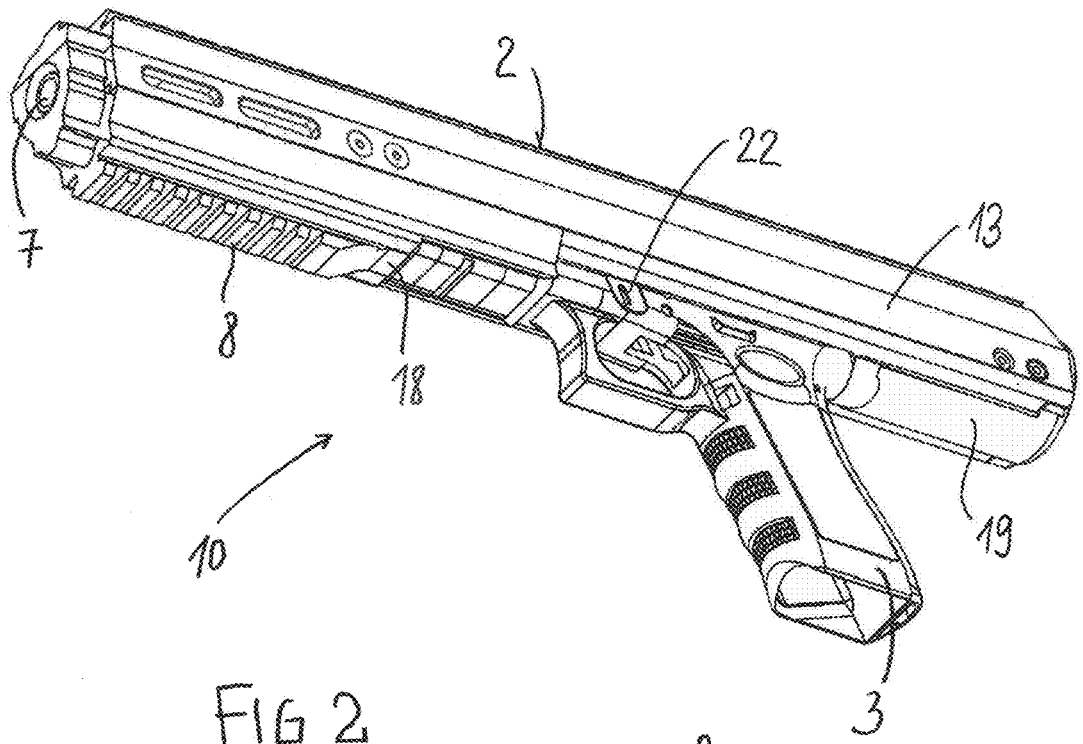
FIG. 1 shows a converted pistol in a perspective view obliquely from below.

All the figures do not show the invention to scale, but merely schematically and only with its essential component parts. The same reference signs in this case correspond to elements of the same function or a comparable function.

The conversion kit 1, also referred to hereinafter as the interchangeable system, serves for converting a self-loading pistol into a pistol carbine 10 of the same caliber. The invention is described by way of example on the basis of a self-loading pistol of the Glock type. However, the invention is not restricted to this type of pistol. In particular, the conversion kit 1, provided with correspondingly adapted components, can also be used for self-loading pistols from other manufacturers, such as for example SIG Sauer, Walther, Heckler & Koch, etc.

The conversion kit 1 comprises a housing (outer housing) 2, which is designed for producing a connection to a frame 3 of the handgun and for this comprises a linear guide 4 for receiving the handgun frame 3. In the illustrated embodiment of the invention, the conversion kit 1 comprises along with the housing 2, which has the linear guide 4, a breechblock 5 modified with respect to the original handgun breechblock (receiver, slide).

Together with the slide 5 of the conversion kit 1, a modified action spring 6 may be advantageously used for returning the slide 5 after firing a shot, in particular a return spring 6 with an increased stiffness in comparison with the original spring. This allows particularly reliable closing of the slide 5 and rapid loading of the converted firearm 10 to be ensured and allows the recoil of the converted handgun 10 to be reduced in comparison with the original handgun.

The conversion kit 1 also comprises a barrel 7, the length of which is typically greater than the length of the original barrel. The barrel 7 of the interchangeable system 1 is preferably mounted in a barrel retaining block 24, which is connected to the housing 2 of the interchangeable system 1 by a screwed connection.

In other words, it is proposed that, in the manner of an interchangeable system, not only a different barrel 7 but also a different slide 5 is used. The original handgun is therefore not merely fitted into a housing 2, but instead a different barrel 7 and a different slide 5, adapted for use within the converted firearm 10, are used, in order to obtain the converted firearm 10.

The original pistol is a recoil-operated automatic weapon with a slide that locks by the Browning system. The barrel and the slide run back together until the pressure has dropped. For unlocking, the barrel is tipped down to the rear. In the case of the converted firearm 10, unlike in the case of the original pistol, the barrel 7 is rigid and the locking takes place on the blowback-action principle. Because the barrel 7 no longer tips down after firing the shot, increased intrinsic precision of the converted firearm 10 is achieved.

With the aid of the interchangeable system 1, the firearm can be easily and reversibly converted from a Browning system with a tipped-down barrel to a firearm 10 with a rigid barrel 7.

Optionally, the conversion kit 1 comprises a stock (not represented) that can be connected to the housing 2 or is connected to the housing 2. In particular, the use of greater barrel lengths and the use of a shoulder stock allow the precision of the firearm 10 thus obtained to be increased in comparison with the original handgun. Thus, instead of the barrel of an original "Glock 17", which has a length of 114 mm, optionally a barrel 7 with a length of for example 200 mm, 250 mm, 300 mm or 410 mm (16") may be used. The use of a holster stock allows the precision of the converted firearm 10 to be improved further. The stock is preferably a folding stock or retractable stock, which may have further possibilities for adjustment to adapt to the anatomy of the shooter.

This modular structure of the interchangeable system 1 provides a great number of possibilities for configuration. The handgun used can not only be converted into a pistol carbine 10. The converted handgun 10 can also be individually designed by using different lengths of barrel and types of stock. If possibilities for fastening accessories are provided on the housing 2, for example mounting rails 8, the converted handgun 10 can be equipped with a great number of accessories.

Provided on the upper side of the housing 2 is a mounting rail 8, for example a Picatinny rail, on which further accessories can be releasably mounted, for example an aiming device. Mounting rails 8 may also be attached to other components of the conversion kit 1. The converted firearm 10 can be used with original Glock magazines (not depicted).

For establishing the connection between the handgun frame 3 and the interchangeable system housing 2 with the aid of the linear guide 4, in one embodiment of the invention the linear guide 4 comprises guiding grooves 11. These guiding grooves 11 serve for receiving guide rails 12 of the handgun frame 3 and are formed so as to correspond to the measurements and dimensioning of the frame guide rails 12. The offset guide rails 12 of the frame 3 and the guiding grooves 11 of the housing 2 in this case form corresponding guiding elements. The guide rails 12 of the frame 3, which are typically produced from a metallic material, are for example molded into the plastics material (polymer material) of the frame body. In an alternative configuration (not represented), however, the linear guide 4 of the interchangeable system housing 2 may however also form guide rails, which interact with corresponding guiding grooves on the frame 3 of the handgun to form a connection.

In a particularly simple variant, which is not represented in the figures, the linear guide 4 is provided by the housing 2 of the interchangeable system 1 itself, in particular the housing walls 13 of this housing 2, without further components being required for this. The housing 2 is preferably a component that is produced from aluminum or glass-fiber reinforced plastic.

Figure 2:
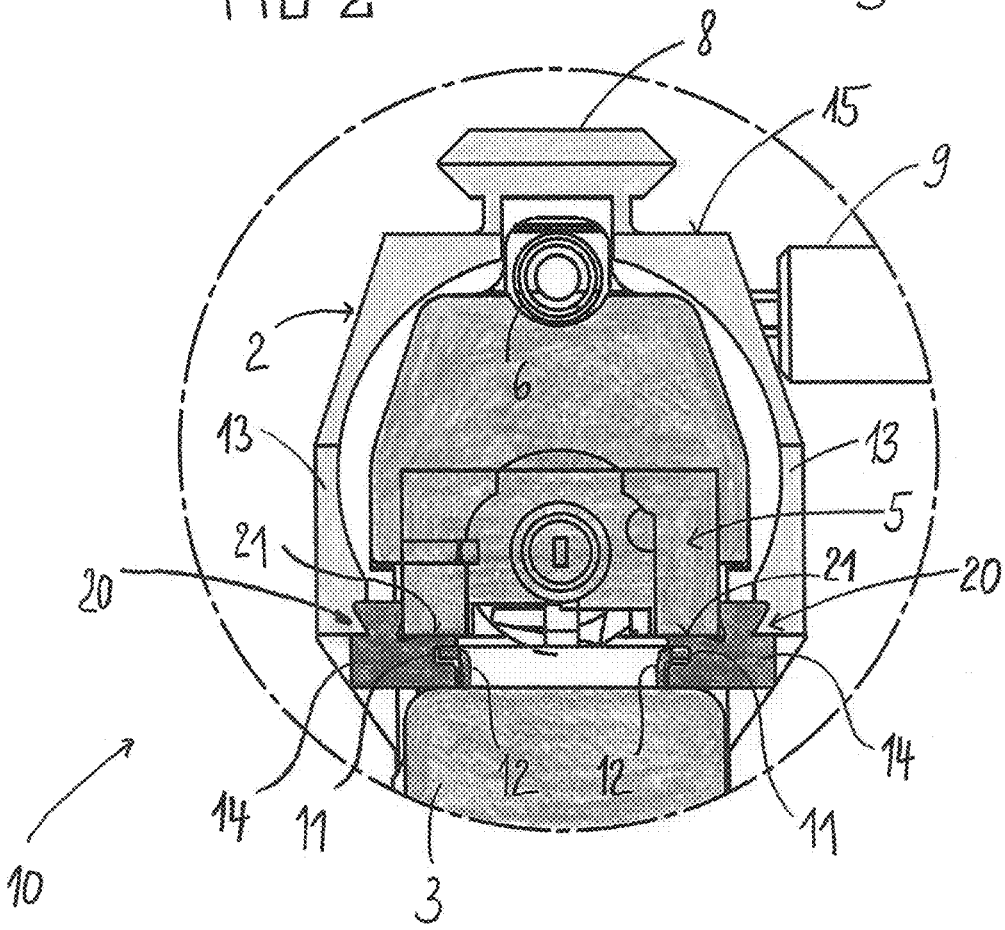
FIG. 2 shows a view of a detail of the connection between the housing and the handgun frame (sectional representation)
Figure 3:
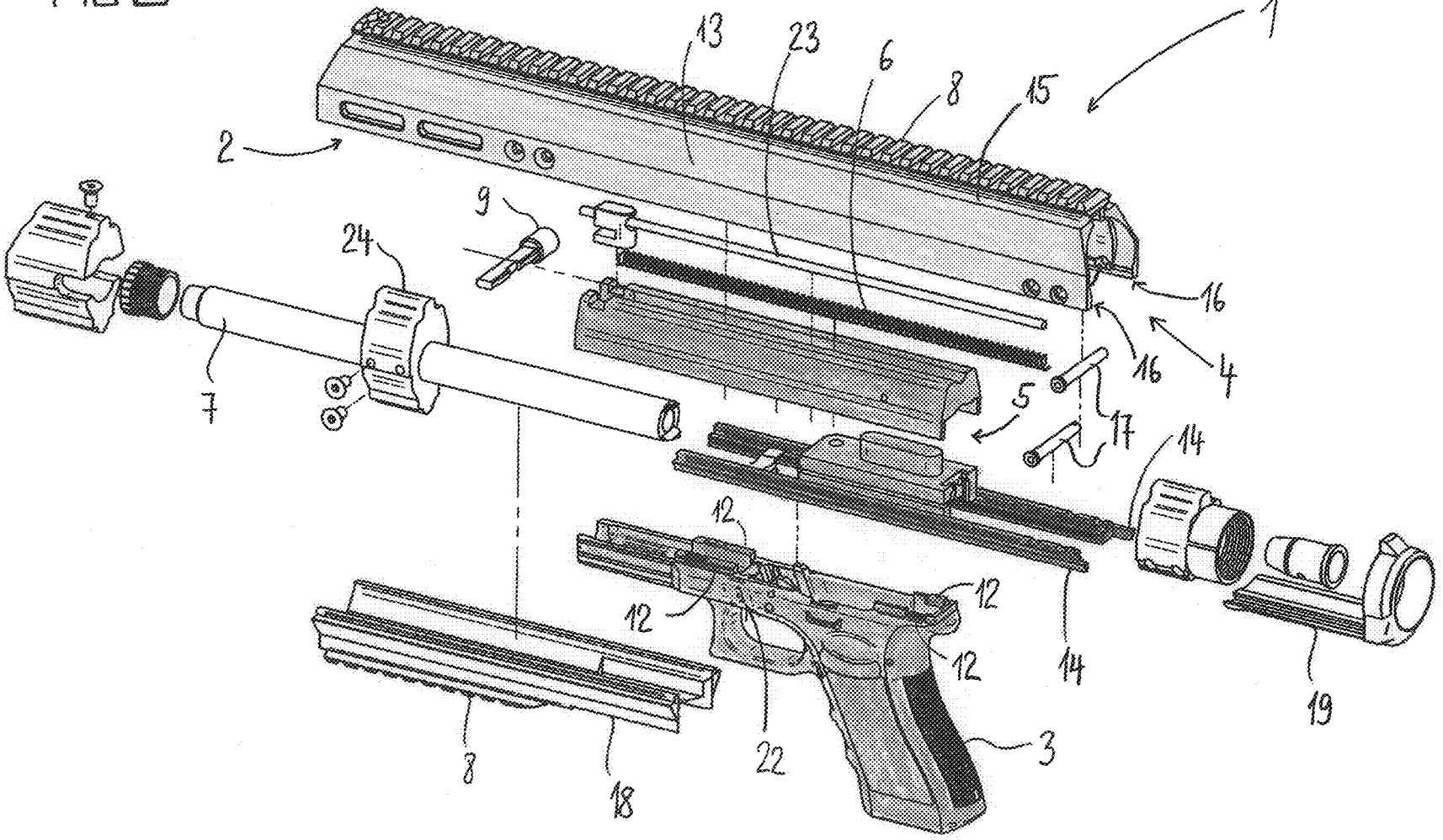
FIG. 3 shows an exploded representation of the converted pistol, comprising a frame of the basic weapon and parts of the conversion kit.

As an alternative to this variant, in which the linear guide 4 is formed by the interchangeable system housing 2 itself, the linear guide 4 comprises a pair of rail-like guiding elements 14 that are attached in or on the interchangeable system housing 2, or the linear guide 4 is formed by such guiding elements 14, see FIGS. 1 to 3. To put it another way, in this particularly advantageous embodiment of the invention, the linear guide 4 is formed as a rail guide, wherein the guide rails 14 have a specific guiding profile and are arranged parallel next to one another in pairs.

If the linear guide 4 or the number of guiding grooves 11 is provided by linear guiding elements (rails) 14 that are arranged on the housing 2 of the interchangeable system 1 and receive the handgun frame 3, these rails 14 serve as an interface or connecting point between the interchangeable system 1 and the handgun frame 3.

The rails 14 advantageously consist of a different material than the housing 2, in particular a material that wears less. The rails 14 are preferably produced from steel or from some other high-strength, low-wearing material, while the interchangeable system housing 2 consists of aluminum or glass-fiber reinforced plastic. Consequently, the rails 14 offer the necessary strength, including resistance to wear, to ensure permanently backlash-free mounting of the handgun frame 3 on the housing 2.

In the example illustrated here, the interchangeable system housing 2 has an essentially U-shaped cross section, wherein the base of the U forms the upper side 15 of the housing 2 and the two legs of the U form the side walls 13 of the housing 2. At the free ends of the legs of the U, in other words at the free ends of the walls 13, the rails 14 are attached.

The rails 14 are preferably connected to the housing 2 of the interchangeable system 1 in a form-fitting manner. Preferably, the rails 14 are held in the housing 2 of the interchangeable system 1 in a manner allowing them to slide in, in rail guides 16 provided for this purpose on housing walls 13, for example configured as prism guides, T-grooves or the like, without an additional screwed connection or further connecting measures being necessary for this. The corresponding connecting profile 20 used for this, of the rails 14 or of the rail guides 16, may for example be a dovetail profile.

Therefore, in the illustrated embodiment, corresponding profiled elements are used not only for providing planar guiding surfaces for the formation of retractable guides for amounting connection between the handgun frame 3 and the interchangeable system housing 2, but also for retractable guides for the connection of the rails 14 to the interchangeable system housing 2 or the rail guides 16 of the housing 2. The rails 14 consequently represent a sturdy, stable receptacle for the handgun frame 3. Generally, the guiding surfaces are designed such that there is a form fit between the components, at least to the extent that a movement is only possible along a straight path. These guides may be open or closed retractable guides, with the form fit being partly replaced by a force fit in the case of closed retractable guides.

If the pair of rails 14 is attached to the interchangeable system housing 2, it provides two guiding grooves 11 facing one another, which serve as a rail guide for the handgun frame 3.

As an alternative to an arrangement of the rails 14 on the housing 2 of the interchangeable system 1 that is not screwed or additionally connected in some other way, it is possible to fasten the rails 14 on the interchangeable system housing 2 with the aid of additional connecting elements, for example with the aid of a screwed connection, with the aid of clamping pins 17 or by a preferably re-releasable adhesive bond. However, other suitable form- and/or force-fitting or material-bonding connections can also be used for fastening the rails 14 on or in the housing 2. For example, when using a housing 2 of a plastics material that is produced with the aid of an injection-molding process or the like, the rails may alternatively also be molded in the housing 2.

It may advantageously be provided that the rails 14 are dimensioned such that, when the frame 3 is inserted, they are braced by the frame 3 against the housing walls 13 of the interchangeable system housing 2. Even without the frame 3, this bracing may be achievable, for example by a suitable further clamping element which is placed between the pair of rails 14. This may be for example a housing plate or the like that can be pushed in between the rails 14 and closes off the interchangeable system housing 2 in the downward direction. In the example, two such plates are provided, specifically a front housing covering 18, which has a further mounting rail 8, and a rear housing covering 19, which, when considered in the direction of the barrel, can be placed in front of or behind the mounted frame 3.

It is particularly advantageous if the rails 14 are exchangeably connected to the interchangeable system housing 2. For this purpose, the connection of the rails 14 to the housing 2 is releasably formed. The intended exchangeability of the rails 14 not only allows damaged rails 14 to be easily exchanged. Differently dimensioned rails 14 can also be used with one and the same housing 2. The interchangeable system 1 can consequently be used for different handgun frames 3, without modifications to the interchangeable system housing 2 being necessary for this. The rails 14 are in this case therefore not an integral component part of the interchangeable system housing 2.

In conjunction with the exchangeability of the rails 14, it is of advantage if the profile of the rails 14 is variable, i.e. rails 14 with different profiles can be connected to the housing 2. On the one hand, in connection with the rail guide 16 on the housing 2, that connecting profile 20 by which the rails 14 are held on the housing 2 of the interchangeable system 1 or are connected to the housing 2 can be modified in a suitable way. On the other hand, the profile of the rails 14 providing the guiding grooves 11 for the connection of the interchangeable system housing 2 to the handgun frame 3 can vary in a suitable way. In particular, as a result, different rails 14 can be provided for different pistol models. Since the rails 14 are advantageously exchangeably connected to the interchangeable system housing 2, one and the same housing 2 of the conversion kit 1 can be used with handgun frames 3 of different handgun models, as long as it is in each case equipped with suitable rails 14.

It is most particularly advantageous if the linear guide 4 serves at the same time for guiding the slide 5, or in other words the rails 14 that serve for receiving the handgun frame 3 at the same time guide the interchangeable system slide 5. The interchangeable system slide 5 then runs on the rails 14 of the interchangeable system housing 2, or is guided on these rails 14. In such an embodiment of the invention, the rails 14 at the same time represent the slide guide. In the exemplary embodiment shown, the slide 5 runs on guiding surfaces 21 of the pair of rails 14, which are provided in the interior of the housing 2 of the interchangeable system 1 above the guiding grooves 11 for the frame 3.

Since the interchangeable system slide 5, preferably produced from steel, runs on rails 14 of the interchangeable system housing 2 that are preferably likewise produced from steel, the interchangeable system housing 2, which is preferably produced from aluminum or plastic, is relieved of loading with regard to material wear.

Preferably, the rails 14 in the interchangeable system housing 2 serve not only for receiving the handgun frame 3 and for guiding the interchangeable system slide 5, but in addition optionally also for carrying locking and operating elements of the converted firearm 10.

The rails 14 provided on the interchangeable system housing 2 are preferably formed continuously over a minimum length, i.e. without interruption. If required, however, the rails 14 may have suitable interruptions or else deviations from the typical rail form, for example clearances for the slide stop lever of the pistol. The form of the rail-like connecting elements 14 may deviate from the typical rail form, for example because these rails 14 interact with functional elements of the handgun frame 3, for example for locking or arresting the connection between the frame 3 and the interchangeable system housing 2.

If the frame 3 is inserted into the interchangeable system housing 2 and is held there in the linear guide 4, a fixing of the position of the frame 3 then advantageously takes place on the rails 14. This takes place for example in exactly the same way as the arresting of the original slide in the original handgun, i.e. with the aid of a locking slide 22 provided on the frame 3. In other words, the housing 2 is pulled in the direction of the rear side of the frame 3 or the frame 3 is pushed in the direction of the front end of the housing 2, seen in the direction of the barrel, until the spring-mounted locking slide 22 is pressed upward, in order to arrest the frame 3 in the housing 2. By this arresting, the mounted parts held in relation to one another in the retractable guide (frame 3 and housing 2) are (releasably) connected to one another. Alternative types of fixing of the frame 3 in a specific longitudinal position in the linear guide 4 are possible. Thus, for example, the frame 3 may also be held in a desired final mounted position in the housing 2 by parts of the housing 2 preventing the frame 3 mounted in the linear guide 4 from moving in relation to the housing 2. This may for example involve the housing covering 18 and/or the housing covering 19, or else other housing parts (not depicted) serve as movement restrictors or stop elements.

In a conversion of a handgun, the frame 3 is pushed onto the linear guide 4 of the interchangeable system housing 2, or pushed into the linear guide 4, from the open rail side, that is to say preferably from the rear when seen in the direction of the barrel. The front and rear guide rails 12 of the frame 3, which in the original handgun engage in the rail guides of the original slide, thereby engage in the guiding grooves 11 of the pair of rails 14 on the interchangeable system housing 2, so that the guide rails 12 of the frame 3 run in the guiding grooves 11 of the pair of rails 14.

Such a conversion can be carried out easily and safely. The number of possible assembly errors is reduced in comparison with known conversion kits or interchangeable systems. The described conversion allows a firearm with a movable, short barrel and low precision to be easily and reversibly converted into a firearm 10 with greater precision.

All of the features presented in the description, the following claims and the drawing may be essential to the invention both individually and together in any desired combination.

LIST OF DESIGNATIONS

1 Conversion kit, interchangeable system
2 Housing
3 Frame of the handgun
4 Linear guide
5 Breechblock (Slide)
6 Action spring, return spring
7 Barrel, interchangeable barrel
8 Mounting rail
9 Clamping slide
10 Converted firearm, pistol carbine
11 Guiding groove
12 Guide rail
13 Housing wall, side wall
14 Guiding element, guide rail, rail
15 Housing upper side
16 Rail guide
17 Clamping pin
18 Front housing covering
19 Rear housing covering
20 Connecting profile
21 Guiding surface
22 Locking slide
23 Spring guiding rod
24 Barrel retaining block

The invention claimed is:

1. A conversion kit for a pistol having a handgun frame, the conversion kit being configured for converting the pistol into a pistol carbine, the conversion kit comprising:

a conversion kit slide being modified with respect to an original handgun slide of the pistol, and a conversion kit housing configured to establish a connection to the handgun frame, said conversion kit housing having a linear guide for receiving the handgun frame, wherein said linear guide is a separate element having rail-shaped guiding elements secured to the conversion kit housing and serving as an interface between the conversion kit housing and the handgun frame, and wherein said linear guide is formed with guiding grooves configured for receiving guide rails of the handgun frame, which in an original state of the pistol engage in rail guides of the original handgun slide of the pistol.

2. The conversion kit according to claim 1, wherein said linear guide also serves for guiding said conversion kit slide that is modified with respect to the original handgun slide of the pistol.

3. The conversion kit according to claim 1, wherein said rail-shaped guiding elements are attached in or on said conversion kit housing.

4. The conversion kit according to claim 3, wherein said rail-shaped guiding elements are profiled rails.

5. The conversion kit according to claim 3, wherein said rail-shaped guiding elements consist of a material that is different from a material of said conversion kit housing.

6. The conversion kit according to claim 3, wherein said rail-shaped guiding elements are exchangeably connected to said conversion kit housing.

7. A method for converting a pistol into a pistol carbine, the method comprising:

providing a conversion kit according to claim 1; and pushing to slide the handgun frame with the guide rails, which in the original slide engage in the rail guides of the original slide, into the linear guide of the housing of the conversion kit, wherein the guiding grooves of the linear slide receive the guide rails of the handgun frame.

8. A handgun, comprising parts of a pistol and parts of a conversion kit, wherein the handgun has been converted into the pistol carbine by using the conversion kit according to claim 1.

* * * * *